US005383333A

United States Patent [19]

Logothetis et al.

[11] Patent Number: 5,383,333

[45] Date of Patent: Jan. 24, 1995

[54] METHOD FOR BIASING A HEGO SENSOR IN A FEEDBACK CONTROL SYSTEM

[75] Inventors: Eleftherios M. Logothetis, Birmingham; Douglas R. Hamburg, Bloomfield Hills; Jeffrey A. Cook; Lajos Rimai, both of Dearborn, all of Mich.

[73] Assignee: Ford Motor Company, Dearborn, Mich.

[21] Appl. No.: 132,267

[22] Filed: Oct. 6, 1993

[51] Int. Cl.[6] ..... F01N 3/20

[52] U.S. Cl. ..... 60/276; 60/285; 123/703

[58] Field of Search ..... 60/274, 276, 285; 123/703

[56] References Cited

U.S. PATENT DOCUMENTS

| | | | |
|---|---|---|---|
| 4,046,118 | 9/1977 | Aono | 123/119 EC |
| 4,057,042 | 11/1977 | Aono | 60/276 |
| 4,167,924 | 9/1979 | Carlson et al. | 123/119 EC |
| 4,167,925 | 9/1979 | Hosaka et al. | 123/119 EC |
| 4,210,106 | 7/1980 | Wessel et al. | 123/489 |
| 4,278,060 | 7/1981 | Isobe et al. . | |
| 4,534,330 | 8/1985 | Osuga et al. | 123/440 |
| 4,625,698 | 12/1986 | Jamrog . | |
| 4,817,383 | 4/1989 | Masul . | |
| 4,817,384 | 4/1989 | Okumura et al. . | |
| 5,025,767 | 6/1991 | Kume et al. . | |

OTHER PUBLICATIONS

Closed Loop Carburetor Emission Control System—R. A. Spilski and W. D. Creps pp. 145–154.

*Primary Examiner*—Ira S. Lazarus
*Assistant Examiner*—Daniel J. O'Connor
*Attorney, Agent, or Firm*—Allan J. Lippa; Roger L. May

[57] ABSTRACT

A system for maintaining engine air/fuel operation within the efficiency window of a catalytic converter. Fuel delivered to the engine is adjusted in response to a step change in an output of an exhaust gas oxygen sensor positioned upstream of the converter. The step change is shifted in response to an error signal derived from a downstream emissions sensor.

13 Claims, 6 Drawing Sheets

METHOD FOR BIASING A HEGO SENSOR IN A FEEDBACK CONTROL SYSTEM

BACKGROUND OF THE INVENTION

The field of the invention relates to control systems for maintaining engine air/fuel operation within the peak efficiency window of a catalytic converter.

Several closed-loop air/fuel control systems are known which utilize dual exhaust gas oxygen (EGO) sensors, one upstream and one downstream of a catalytic converter. Ideally, the output of the upstream EGO sensor should have a step change at stoichiometry. It has been found, however, that the sensor step change tends to shift from stoichiometry as a result of component aging and other sensor properties such as response time asymmetry. Overall system characteristics such as incomplete exhaust gas mixing may also cause shifts away from peak catalyst efficiency. Moreover, the efficiency window of the catalyst may not be at stoichiometry. Accordingly, there may be a mismatch between the sensor step change output and the catalyst efficiency window.

Several methods of biasing have conventionally been used to address this sensor-catalyst mismatch. For example, the sensor output is typically compared to a reference value at the midpoint of its step to generate a rich or lean indication, and the reference may be changed from the midpoint to bias the rich/lean indication. However, this biasing method is limited to a very narrow range of air/fuel values because of the loss of sensor sensitivity away from the narrow linear region around the midpoint. For those systems which employ integral or proportional plus integral feedback control, biasing may be added to the feedback controller. For example, the integration rate in the lean direction may be changed from the rich direction. However, the resulting asymmetry may result in periodic engine operation outside of the converter's efficiency window.

SUMMARY OF THE INVENTION

An object of the invention herein is to provide a system which aligns the step change of an exhaust gas oxygen sensor output with the efficiency window of a catalytic converter.

The above object is achieved, and problems of prior approaches overcome, by providing a system for maintaining engine air/fuel operation within the efficiency window of a catalytic converter positioned in the engine exhaust. In one particular aspect of the invention, the system comprises an exhaust gas oxygen sensor positioned upstream of the converter having an output with a step change between first and second output states at a selected air/fuel ratio determined by a biasing means, fuel control means for adjusting fuel delivered to the engine in response to an output of the upstream sensor, error means for generating an error signal related to variance between a selected air/fuel ratio and the converter efficiency window, and the biasing means being responsive to the error signal for shifting the sensor output to reduce the error signal. Preferably, the error means is responsive to a downstream emission feedback sensor.

An advantage of the above described aspect is that the step change in the upstream EGO sensor output is aligned with the efficiency window of the catalytic converter, thereby providing highly accurate air/fuel control.

BRIEF DESCRIPTION OF THE DRAWINGS

The object and advantages of the invention claimed herein and others will be more clearly understood by reading an example of an embodiment in which the invention is used to advantage with reference to the attached drawings wherein:

DESCRIPTION OF AN EMBODIMENT

Figure 1:
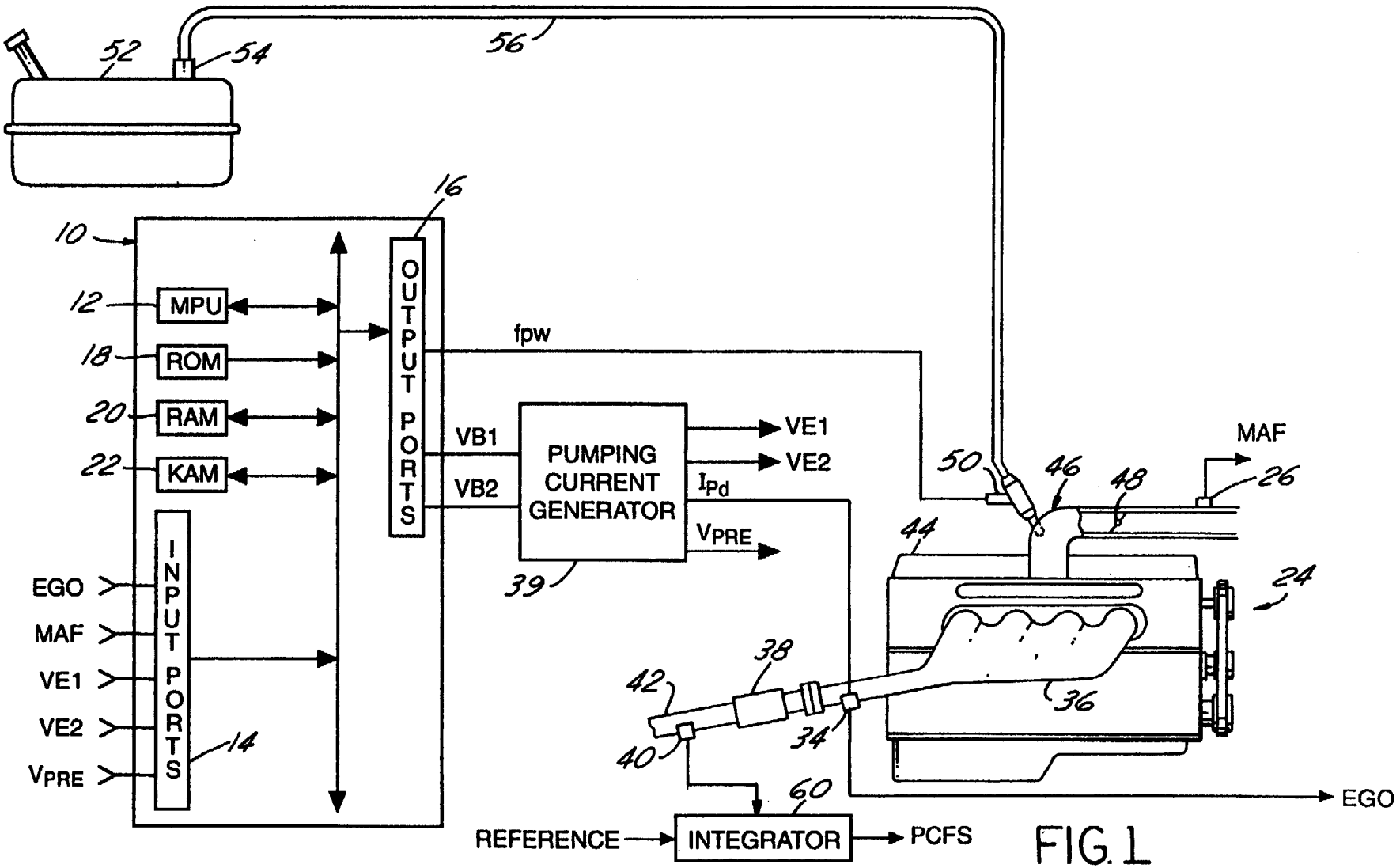
FIG. 1 is a block diagram of an embodiment wherein the invention is used to advantage.

Controller 10 is shown in the block diagram of FIG. 1 as a conventional microcomputer including: microprocessor unit 12; input ports 14 including both digital and analog inputs; output ports 16 including both digital and analog outputs; read only memory (ROM) 18 for storing control programs; random access memory (RAM) 20 for temporary data storage which may also be used for counters or timers; keep-alive memory (KAM) 22 for storing learned values; and a conventional data bus.

In this particular example, pre-catalyst exhaust gas oxygen (EGO) sensor 34 is shown coupled to exhaust manifold 36 of engine 24 upstream of conventional catalytic converter 38. Pumping current generator 39 is shown interposed between controller 10 and pre-catalyst EGO sensor 34. Post-catalyst EGO sensor 40 is shown coupled to tailpipe 42 downstream of conventional catalytic converter 38.

Intake manifold 44 is shown coupled to throttle body 46 having primary throttle plate 48 positioned therein. Throttle body 46 is also shown having fuel injector 50 coupled thereto for delivering liquid fuel in proportion to pulse width signal fpw from controller 10. Fuel is delivered to fuel injector 50 by a conventional fuel system including fuel tank 52, fuel pump 54, and fuel rail 56.

Figure 2A:
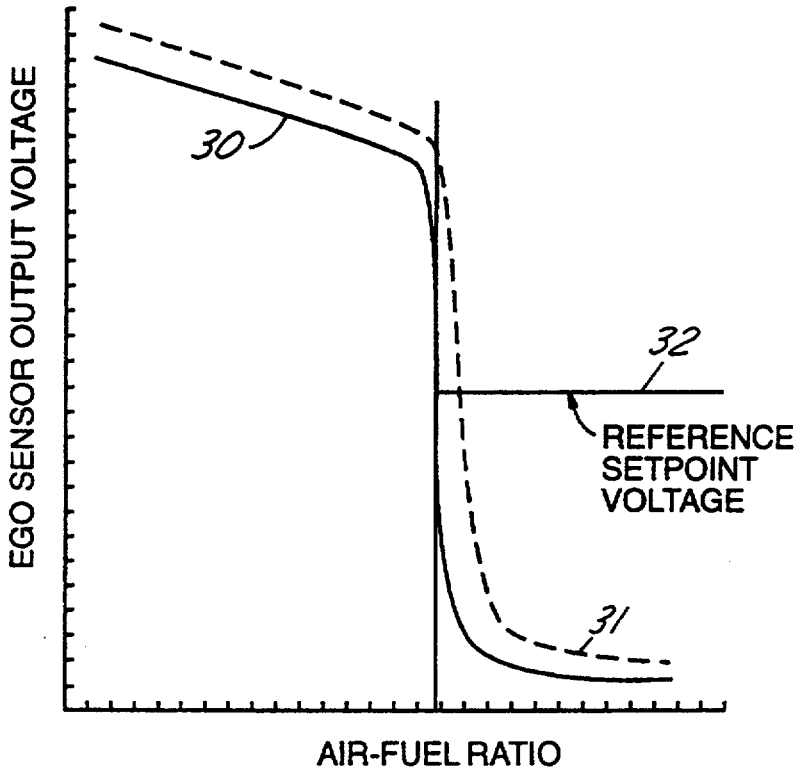
FIGS. 2A and 2B illustrate various outputs associated with an exhaust gas oxygen sensor.
Figure 2B:
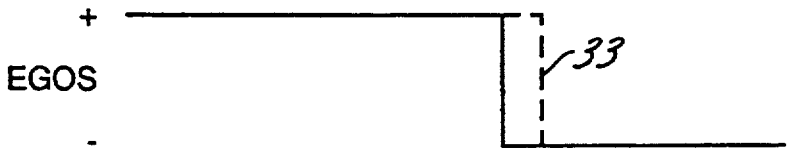

As shown in FIGS. 2A and 2B, a step change in the output of EGO sensor 34 has a midpoint which occurs at an air/fuel ratio (AFR) which is predetermined for a particular sensor. The inventors herein have found that predetermined ratio AFR may not coincide with stoichiomery or the converter's efficiency window. Signal EGOS, as described in greater detail later herein, is generated by comparing the output voltage of EGO sensor 34 (line 30) to a reference voltage (line 32) shown in this example at a midpoint in peak-to-peak excursion of the output step change from EGO sensor 34. Signal EGOS is a two-state signal which indicates whether combustion gases are rich or lean of the air/fuel ratio corresponding to the output midpoint from EGO sensor 34. For the particular example presented herein, dashed lines 31 and 33 in FIGS. 2A and 2B respectively represent shifts in EGO sensor 34 output and EGOS with respect to the converter's efficiency window.

Figure 3:
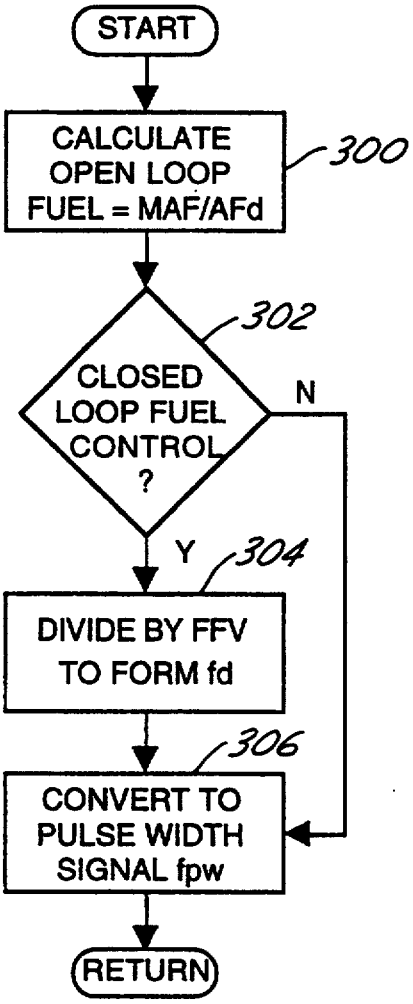
FIGS. 3 and 4 are high level flowcharts illustrating various steps performed by a portion of the embodiment illustrated in FIG. 1.

A flowchart of the liquid fuel delivery routine executed by controller 10 for controlling engine 24 is now described beginning with reference to the flowchart shown in FIG. 3. An open loop calculation of desired liquid fuel is calculated in step 300. More specifically, the measurement of inducted mass airflow (MAF) is divided by a desired air/fuel ratio (AFd) correlated with stoichiometric combustion. After a determination is made that closed loop or feedback control is desired (step 302), the open loop fuel calculation is trimmed by fuel feedback variable FFV to generate desired fuel signal fd during step 304. This desired fuel signal is converted into fuel pulse width signal fpw for actuating fuel injector 50 (step 306).

Figure 4:
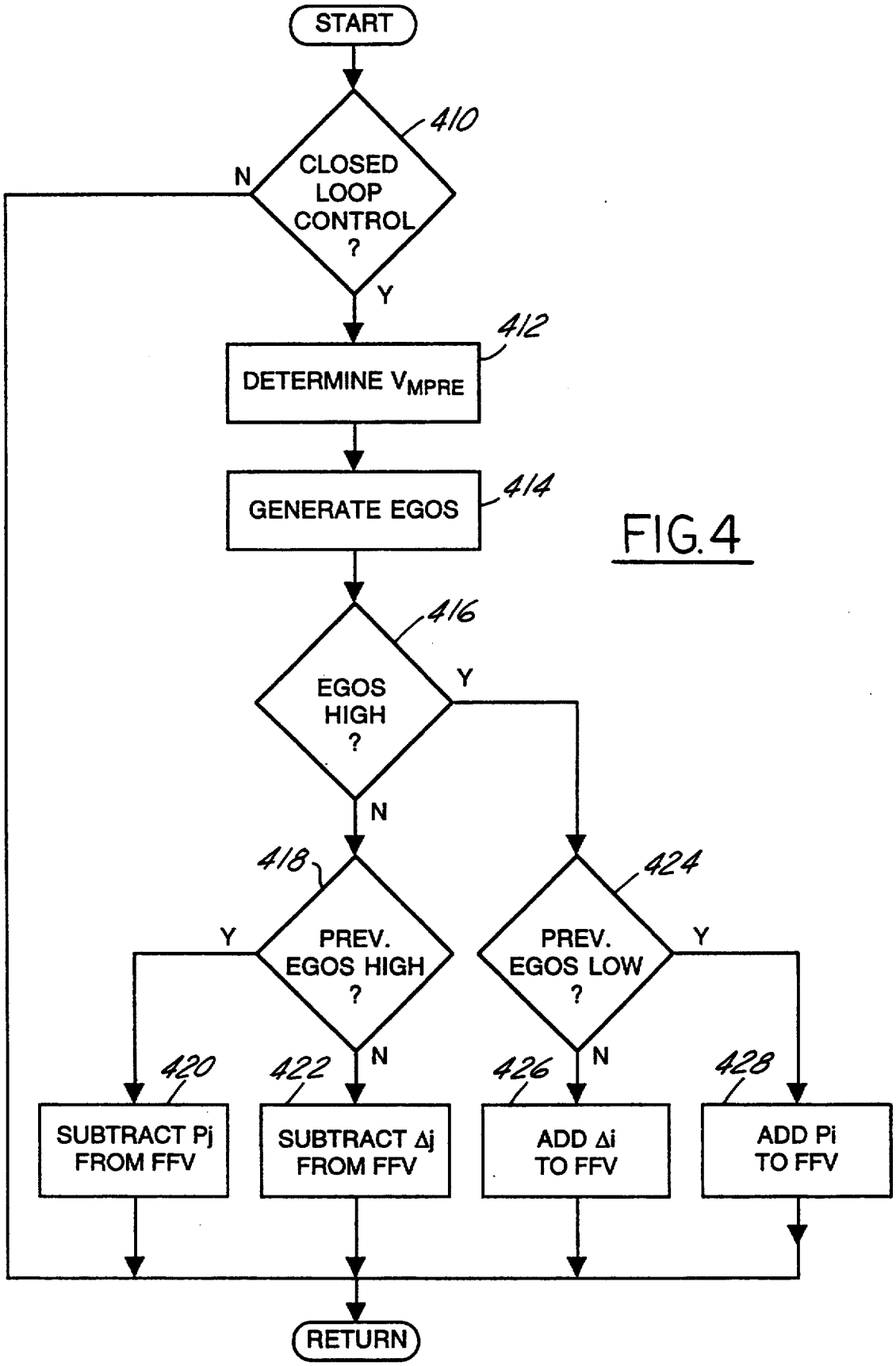

The air/fuel feedback routine executed by controller 10 to generate fuel feedback variable FFV is now described with reference to the flowchart shown in FIG. 4. After determining that closed loop air/fuel control is desired in step 410, modified output voltage $V_{MPRE}$ derived from EGO sensor 34 is read (step 412) from the internal impedance correction routine described in greater detail later herein with reference to FIG. 6B. As also described in greater detail later herein, the step output of EGO sensor 34 is modified or shifted by biasing EGO sensor 34 in response to post-catalyst emissions feedback signal PCFS to align the output step change with the converter's efficiency window. Two-state exhaust gas oxygen sensor signal EGOS is generated in step 414 by comparing modified output voltage $V_{MPRE}$ to reference 32 (see FIG. 2A). When signal EGOS is low (step 416), but was high during the previous background loop of microcontroller 10 (step 418), preselected proportional term Pj is subtracted from feedback variable FFV (step 420). When signal EGOS is low (step 416) and was also low during the previous background loop (step 418), preselected integral term Δj is subtracted from feedback variable FFV (step 422).

Similarly, when signal EGOS is high (step 416), and was also high during the previous background loop of controller 10 (step 424), integral term Δi is added to feedback variable FFV (step 426). When signal EGOS is high (step 416), but was low during the previous background loop (step 424), proportional term Pi is added to feedback variable FFV (step 428).

Figure 5:
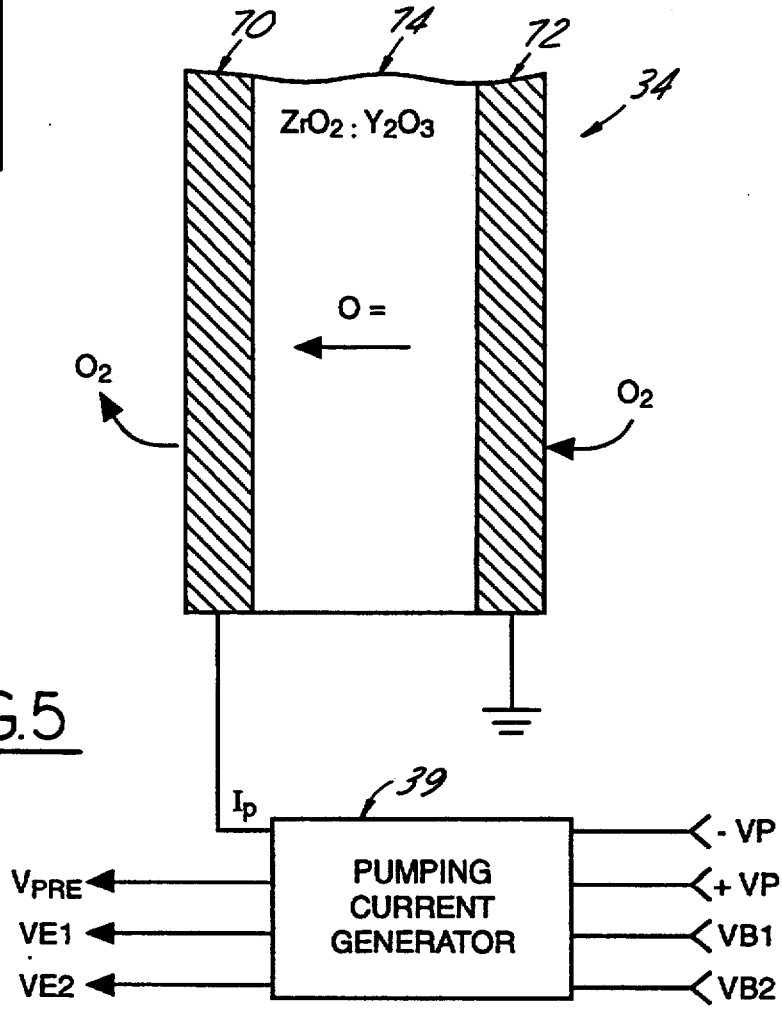
FIG. 5 is a sectional view of an exhaust gas oxygen sensor illustrating oxygen pumping in a portion thereof.

In one embodiment shown in FIG. 5, EGO sensor 34 includes first and second electrodes 70 and 72 of differing oxygen concentrations separated by oxygen-ion-conducting material 74. Theoretically, a step change or "switch point" of the sensor output coincides with the peak efficiency window of converter 38. However, the step change is typically shifted to a different value because of component aging or other system characteristics. To correct for such shifts, EGO sensor 34 is biased by generating current flow in first electrode 70 so that oxygen is transferred or "pumped" from first electrode 70 to second electrode 72 or vice versa through oxygen-ion-conducting material 74. The current flow generated shifts the step change to higher or lower air/fuel values depending on the direction of the pumping current. Specifically, positive current flow in electrode 70 will shift the switch point toward leaner air/fuel ratios and negative current flow in electrode 70 will shift the switch point toward richer air/fuel ratios. Moreover, the magnitude of this shift increases proportionally with the magnitude of the current. As described in greater detail later herein, the step change in the output of EGO sensor 34 is shifted in either direction to align with the peak efficiency window of the catalyst.

Figure 6A:
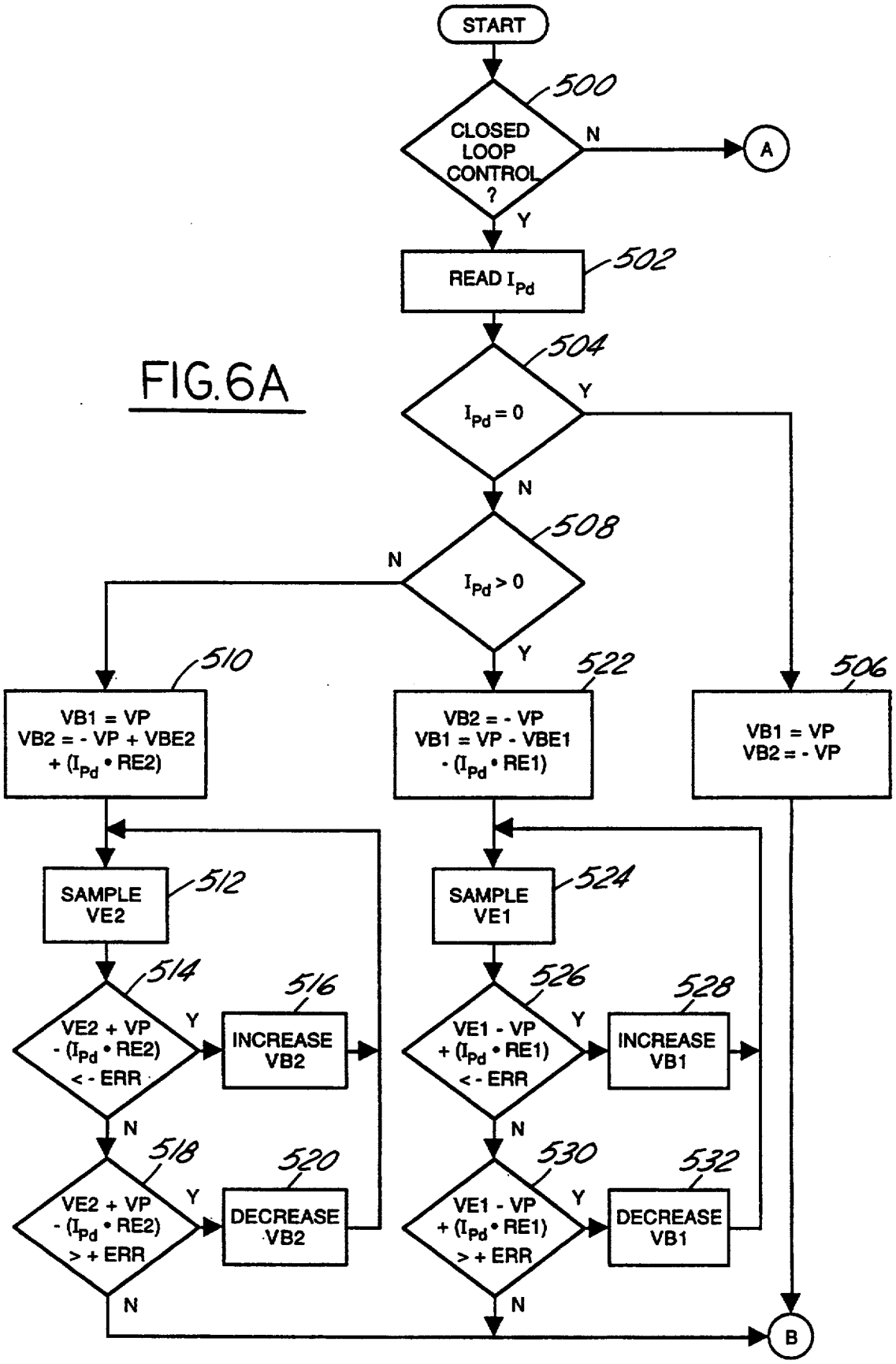
FIGS. 6A–6B are high level flowcharts illustrating various steps performed by a portion of the embodiment illustrated in FIG. 1.
Figure 6B:
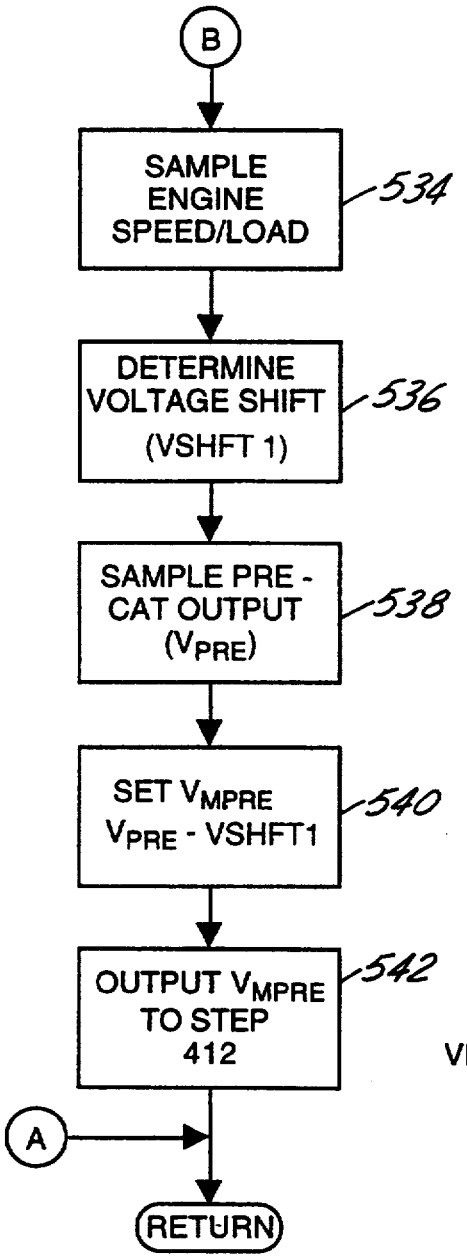
Figure 7:
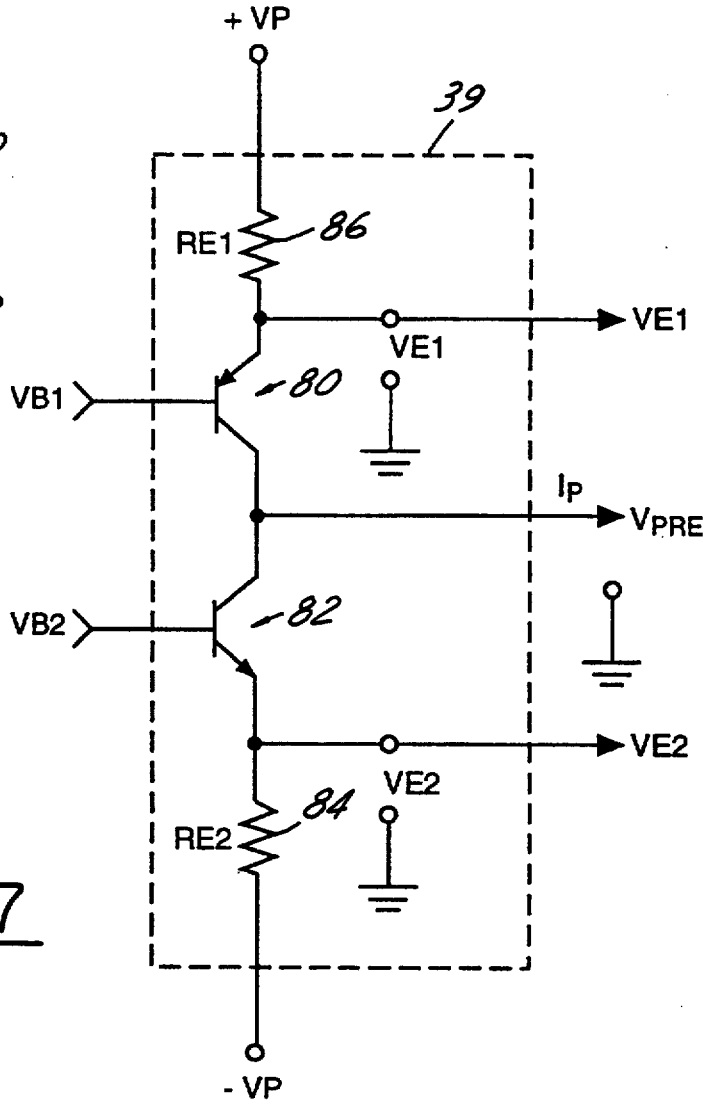
FIG. 7 is a schematic diagram of a portion of the embodiment illustrated in FIG. 1.

Biasing or shifting of EGO sensor 34 is now described in more detail with reference to the flowchart shown in FIGS. 6A-6B, and the circuit diagram of pumping current generator 39 shown in FIG. 7. After determining that closed loop control is desired (step 500), desired pumping current $I_{Pd}$ is generated in response to post-catalyst emissions feedback signal PCFS (step 502). Signal PCFS is an indicator of whether the engine air/fuel, on average, is centered in the catalyst window. In the example presented herein, an error signal is generated by subtracting a reference voltage from the output of a post-catalyst emissions sensing means, such as post-catalyst EGO sensor 40 (shown in FIG. 1), and then integrating the error signal through integrator 60 (shown in FIG. 1). When emission feedback signal PCFS is zero (i.e., no error between average engine air/fuel ratio and the peak converter efficiency window), then desired pumping current $I_{Pd}$ is zero (step 504) and engine air/fuel is centered in the catalyst window. In this condition, no adjustment of the output step change from EGO sensor 34 is required. Accordingly, controller 10 turns off transistors 80 and 82 by setting respective base voltages VB1 and VB2 equal to positive and negative supply voltages +VP and −VP, respectively, so that pumping current will not flow in or out of pre-catalyst EGO sensor 34 (step 506).

When the engine air/fuel is not in the catalyst window, desired pumping current $I_{Pd}$ is changed responsive to emission feedback signal PCFS so that the step change in output voltage of EGO sensor 34 will be shifted into the catalyst window. For example, when desired pumping current $I_{Pd}$ is less than zero (step 508), controller 10 turns transistor 80 off by setting VB1 equal to +VP, and operates transistor 82 in its linear range by adjusting VB2 to control the current flow out of the sensor (step 510). Specifically, $$VB2 = -VP + VBE2 + (I_{Pd} * RE2)$$

wherein VBE2 is the internal base-to-emitter voltage of transistor 82, and RE2 is resistor 84 connected between the emitter of transistor 82 and negative supply voltage −VP. To force actual current flow $I_{Pa}$ out of electrode 70 to be equal to the desired current flow $I_{Pd}$, emitter voltage VE2 of transistor 82 is sampled by controller 10 (step 512) to check the voltage drop across resistor R84. If the voltage drop across resistor 84 is such that VE2+VP−($I_{Pd}$*RE2) is less than lower error limit −ERR, then $I_{Pa}$ is less than $I_{Pd}$ (step 514). Accordingly, VB2 is slightly increased (step 516), thereby increasing the pumping current flow out of electrode 70. Conversely, if the voltage drop across resistor 84 is such that VE2+VP−($I_{Pd}$*RE2) is greater than upper error limit +ERR, then current $I_{Pd}$ is greater than desired pumping current $I_{Pd}$ (step 518). Accordingly, VB2 is slightly decreased (step 520), thereby decreasing the pumping current flow out of electrode 70. Step 512 will repeat until the error is within allowable limits.

Alternatively, when desired pumping current $I_{Pd}$ is greater than zero (step 508), controller 10 turns transistor 82 off by setting VB2 equal to −VP, and operates transistor 80 in its linear range by adjusting VB1 to control the current flow into electrode 70 (step 522). Specifically, $$VB1 = VP - VBE1 - (I_{Pd} * RE1)$$

wherein VBE1 is the internal base-to-emitter voltage of transistor 80, and RE1 is resistor 86 connected between the emitter of transistor 80 and the positive supply voltage +VP. To force actual current flow $I_{Pa}$ into electrode 70 to be equal to the desired current flow $I_{Pd}$, emitter voltage VE1 of transistor 80 is sampled by controller 10 (step 524) to check the voltage drop across RE1. If the voltage drop across resistor 86 is such that VE1−VP+($I_{Pd}$*RE1) is less than some lower error limit −ERR, then $I_{Pa}$ is greater than $I_{Pd}$ (step 526). Accordingly, VB1 is slightly increased (step 528), thereby decreasing the pumping current flow into electrode 70. Conversely, if the voltage drop across resistor 86 is such that VE1−VP+($I_{Pd}$*RE1) is greater than some upper error limit, +ERR, then $I_{Pa}$ is less than $I_{Pd}$ (step 530). Accordingly, VB1 is slightly decreased (step 532), thereby increasing the pumping current being pumped into electrode 70. Step 524 will repeat until the error is within allowable limits.

Pumping current into or out of EGO sensor 34 not only shifts the step change of the sensor output relative to engine air/fuel ratio, but also results in a shift in the output voltage level due to a voltage drop across the internal impedance of EGO sensor 34. Voltage adjustment is provided to compensate for this shift in voltage level as described below. Generally, the internal impedance of EGO sensor 34 depends on the temperature of the engine exhaust. While other temperature determining methods may be used, engine speed and load are used together in the described embodiment as a convenient estimator of temperature. More specifically, with reference to FIG. 65, when the pumping current error is within allowable limits, controller 10 samples engine speed and load (step 534). The value of the shift in voltage amplitude, VSHFT1, is then read from a table providing VSHFT1 as a function of desired pumping current $I_{Pd}$, engine speed, and engine load (step 536). Next, controller 10 samples the output voltage, $V_{PRE}$, of EGO sensor 34 (step 538) and calculates modified output voltage $V_{MPRE}$ of EGO sensor 34 by subtracting VSHFT1 from $V_{PRE}$ (step 540). Modified output voltage $V_{MPRE}$ is then used in the pre-catalyst air/fuel feedback loop to generate signal EGOS as previously described.

Although one example of an embodiment which practices the invention has been described herein, there are numerous other examples which could also be described. For example, other combinations of analog devices and discrete ICs may be used to advantage to generate the current flow in the sensor electrode. The invention is therefore to be defined only in accordance with the following claims.

What is claimed:

1. A system for maintaining engine air/fuel operation within the efficiency window of a catalytic converter positioned in the engine exhaust, comprising:

an exhaust gas oxygen sensor positioned upstream of the converter comprising first and second electrodes, said exhaust gas oxygen sensor having an output with a step change between first and second output states at a selected air/fuel ratio determined by a biasing means;

fuel control means for adjusting fuel delivered to the engine in response to said step change to maintain engine air/fuel operation on average at said selected air/fuel ratio;

error means for generating an error signal related to variance between said selected air/fuel ratio and the converter efficiency window; and said biasing means being responsive to said error signal for shifting said step change and said selected air/fuel ratio to means for generating current flow in said first electrode.

2. The system recited in claim 1 further comprising a downstream emission sensor and wherein said error means is responsive to said downstream emission sensor for generating said error signal.

3. The system recited in claim 2 wherein said downstream emission sensor comprises an exhaust gas oxygen sensor.

4. The system recited in claim 2 wherein said error means includes integration means for integrating a difference between an output of said downstream emission sensor and a reference to generate said error signal.

5. A system for maintaining engine air/fuel operation within the efficiency window of a catalytic converter, comprising:

an exhaust gas oxygen sensor positioned upstream of the converter comprising first and second electrodes of differing oxygen concentrations separated by an oxygen-ion-conducting material, said exhaust gas oxygen sensor having an output with a step change between first and second output states at a selected air/fuel ratio determined by a biasing means;

a downstream emission sensor positioned downstream of the converter;

error means being responsive to said downstream emission sensor for generating an error signal related to variance between said selected air/fuel ratio and the converter efficiency window;

fuel control means for adjusting fuel delivered to the engine in response to said step change to maintain engine air/fuel operation on average at said selected air/fuel ratio; and said biasing means being responsive to said error signal for shifting said step change and said selected air/fuel ratio to reduce said error signal, said biasing means including current means for generating current flow in said first electrode.

6. The system recited in claim 5 wherein said current means pumps current into said first electrode to shift said step change and said selected air/fuel ratio towards a leaner air/fuel ratio, and pumps current out of said first electrode to shift said step change and said selected air/fuel ratio towards a richer air/fuel ratio.

7. The system recited in claim 6 further comprising voltage adjusting means for reducing variations in amplitude in said upstream exhaust gas oxygen sensor output caused by said current means.

8. The system recited in claim 5 wherein said downstream emission sensor comprises an exhaust gas oxygen sensor.

9. The system recited in claim 8 wherein said error means includes integration means for integrating a difference between an output of said downstream emission sensor and a reference to generate said error signal.

10. A system for maintaining engine air/fuel operation within the efficiency window of a catalytic converter positioned in the engine exhaust, comprising:

an exhaust gas oxygen sensor positioned upstream of the converter with an internal impedance dependent upon exhaust gas temperature, said exhaust gas oxygen sensor having an output with a step change between first and second output states at a selected air/fuel ratio determined by a biasing means;

a downstream emission sensor positioned downstream of the converter;

fuel control means for adjusting fuel delivered to the engine in response to said step change to maintain engine air/fuel operation on average at said selected air/fuel ratio;

error means for generating an error signal related to variance between said selected air/fuel ratio and the converter efficiency window; and said biasing means being responsive to said error signal for shifting said step change and said selected air/fuel ratio to reduce said error signal; said biasing means being further responsive to indications of said exhaust gas temperature for adjusting said output to compensate for voltage changes across said internal impedance caused by said biasing means.

11. The system recited in claim 10 wherein said exhaust gas temperature is estimated from engine speed and load.

12. The system recited in claim 10 wherein said downstream emission sensor comprises an exhaust gas oxygen sensor.

13. The system recited in claim 10 wherein said error means includes integration means for integrating a difference between an output of said downstream emission sensor and reference to generate said error signal.

* * * * *